US010864652B2

(12) United States Patent
Oshima et al.

(10) Patent No.: US 10,864,652 B2
(45) Date of Patent: Dec. 15, 2020

(54) METHOD FOR MANUFACTURING HIGH-DENSITY WOOD LAMINATE MATERIAL

(71) Applicant: DAIKEN CORPORATION, Toyama (JP)

(72) Inventors: Katsuhito Oshima, Toyama (JP); Yasushi Sugio, Toyama (JP); Koji Nagaoka, Toyama (JP); Kazuki Sakamoto, Toyama (JP)

(73) Assignee: DAIKEN CORPORATION, Toyama (JP)

( * ) Notice: Subject to any disclaimer, the term of this patent is extended or adjusted under 35 U.S.C. 154(b) by 0 days.

(21) Appl. No.: 16/333,748

(22) PCT Filed: Oct. 1, 2018

(86) PCT No.: PCT/JP2018/036707

§ 371 (c)(1),
(2) Date: Mar. 15, 2019

(87) PCT Pub. No.: WO2019/066085

PCT Pub. Date: Apr. 4, 2019

(65) Prior Publication Data

US 2019/0358849 A1 Nov. 28, 2019

(30) Foreign Application Priority Data

Sep. 29, 2017 (JP) ..... 2017-190348

(51) Int. Cl.
*B27N 1/00* (2006.01)
*B27N 3/04* (2006.01)
*B27N 3/14* (2006.01)

(52) U.S. Cl.
CPC ..... *B27N 1/00* (2013.01); *B27N 3/04* (2013.01); *B27N 3/143* (2013.01)

(58) Field of Classification Search
None
See application file for complete search history.

(56) References Cited

U.S. PATENT DOCUMENTS 6,099,773 A * 8/2000 Reck ..... B27N 3/00 156/296
2004/0241414 A1 12/2004 Egger
(Continued)

FOREIGN PATENT DOCUMENTS

DE 10160316 A1 * 6/2003
DE 10160316 A1 6/2003
(Continued)

OTHER PUBLICATIONS

Canadian Patent Office Action for corresponding application No. 3,037,327, dated May 14, 2019.
(Continued)

*Primary Examiner* — Matthew J Daniels
*Assistant Examiner* — Mohammad M Ameen
(74) *Attorney, Agent, or Firm* — Renner, Otto, Boisselle & Sklar, LLP

(57) ABSTRACT

This method for manufacturing a high-density strand board enables high-density strand boards to be formed by using about the same press pressure as press pressures required to form strand boards with common densities, so that the high-density strand boards can be produced without using special facilities and equipment. A pretreatment process P2 is performed on strands 5 before pressing. The pretreatment process P2 is comprised of a first treatment process P2*a* and a subsequent second treatment process P2*b*. At least one of beating, high-frequency treatment, high-temperature high-pressure treatment, high-water pressure treatment, repeated deaeration and dehydration treatment, and chemical treatment is performed in the first treatment process P2*a*, and roll pressing or flat press pressing is performed in the second
(Continued)

treatment process P2*b*. A strand board B with a density of 750 to 950 kg/m$^3$ is formed by using a press pressure of 4 N/mm$^2$ or less.

5 Claims, 5 Drawing Sheets

(56) References Cited

U.S. PATENT DOCUMENTS

| | | | | |
|---|---|---|---|---|
| 2009/0107643 | A1* | 4/2009 | Petit-Conil | D21B 1/021 162/68 |
| 2016/0257814 | A1* | 9/2016 | Schade | C08L 1/02 |
| 2017/0021525 | A1 | 1/2017 | Weinkotz | |

FOREIGN PATENT DOCUMENTS

| | | | |
|---|---|---|---|
| DE | 19843493 | B4 | 4/2005 |
| DE | 102015119546 | A1 | 5/2017 |
| JP | H07-171808 | A | 7/1995 |
| JP | H09-029711 | A1 | 2/1997 |
| JP | H10-71609 | A | 3/1998 |
| JP | 2000-071216 | A | 3/2000 |
| JP | 2000-117710 | A | 4/2000 |
| JP | 2004-202840 | A | 7/2004 |
| JP | 4307992 | B | 5/2009 |
| JP | 2015-000533 | A | 1/2015 |
| WO | 2017139504 | A1 | 8/2017 |

OTHER PUBLICATIONS

International Search Report and Written Opinion for corresponding App. No. PCT/JP2018/036707, dated Nov. 6, 2018.

Decision to Grant a Patent, corresponding to JP Application No. 2017-190348, Date of Drafting Oct. 29, 2018.

Notification of Reasons for Refusal, corresponding to JP Application No. 2017-190348, Date of Drafting Jun. 6, 2018.

Canadian Patent Office Action for corresponding application No. 3,037,327, dated Sep. 27, 2019.

Partial Search Report issued by EUIPO for corresponding European Patent Application No. 18855128.7 dated Jun. 2, 2020. (**Applicant notes that thirty (30) days have not elapsed since the receipt of the Action).

* cited by examiner

FIG.4

| | | Example 1 | Example 2 | Comparative Example 1 | Comparative Example 2 |
|---|---|---|---|---|---|
| Strands | Density[kg/m$^3$] | 500~600 | 450~550 | 400~500 | 350~450 |
| Multi-Layered Mat | Number of Layers | 5 | 5 | 5 | 5 |
| | Height[mm] | 37 | 35 | 42 | 36 |
| Conditions for Hot Pressing | Pressure[N/m$^2$] | 4 | 4 | 8 | 8 |
| | Time[min] | 10 | 10 | 10 | 10 |
| | Time Required to Obtain Target Thickness[sec] | 196 | 38 | 78 | 15 |
| After Pressing | Density | 818 | 832 | 779 | 812 |
| | Thickness | 12.4 | 12.2 | 12.7 | 12.4 |
| Bending Test | Pmax[N] | 5853 | 4298 | 5608 | 4438 |
| | MOR[N/mm$^2$] | 111 | 84 | 100 | 83 |
| | MOE[N/mm2] | 4964 | 5671 | 3408 | 5179 |
| Water Absorption and Dimensional Change Tests | Dimensional Change[%] (1st Boiling) | 28.6 | 18.0 | 27.7 | 20.9 |
| | Water Absorption[%] (1st Boiling) | 60 | 46 | 61 | 52 |
| | Dimensional Change[%] (2nd Boiling) | 29.7 | 19.1 | 28.4 | 20.6 |
| | Water Absorption[%] (2nd Boiling) | 63 | 60 | 65 | 61 |

METHOD FOR MANUFACTURING HIGH-DENSITY WOOD LAMINATE MATERIAL

CROSS-REFERENCE TO RELATED APPLICATION

This application claims priority to Japanese Patent Application No. 2017-190348 filed on Sep. 29, 2017, the entire disclosure of which is incorporated by reference herein.

BACKGROUND

The present invention relates to methods for manufacturing a high-density wood laminate material.

Today there are less and less tropical hardwood species including broadleaf trees such as Apitong or Keruing (*Dipterocarpus* spp.), and it is difficult to obtain high-quality veneer at low cost. Degradation in quality of plywood using tropical hardwood species has therefore become a big problem. Wood fiberboards such as oriented strand boards (OSBs) are increasingly used as a substitute material for plywood. However, OSBs with common densities do not provide sufficient strength.

Conventionally, Japanese Patent No. 4307992, for example, discloses a large OSB plate having a density as high as at most 700 kg/m$^3$, a length of at least 7 m, and a flexural modulus of at least 7000 N/mm$^2$ in the primary load direction.

SUMMARY

In order to form such a high-density OSB plate having a density as high as 700 kg/m$^3$ or more as disclosed in Japanese Patent No. 4307992, special facilities and equipment designed in consideration of the risk of delamination are required. Without such special facilities and equipment, it is difficult to further increase the density of OSB plates and production efficiency is low.

The present invention was developed in view of the above problem, and it is an object of the present invention to improve a process of manufacturing a high-density wood laminate material so that even a high-density wood laminate material can be formed by using about the same press pressure as press pressures that are required to form wood laminate materials with common densities, thereby enabling a high-density wood laminate material to be manufactured with high production efficiency without using special facilities and equipment.

In order to achieve the above object, according to the present invention, specific pretreatment in which woodbased materials are softened or compressed (squeezed) is performed on the woodbased materials before a stack of the woodbased materials is subjected to pressing.

Specifically, a method for manufacturing a high-density wood laminate material according to the present invention is a method for manufacturing a high-density wood laminate material by orienting and stacking a large number of woodbased materials such that fibers of the woodbased materials extend in a predetermined reference direction to form mats of the woodbased materials, stacking the mats in multiple layers to form a multi-layered mat of the woodbased materials, and compressing and bonding the multi-layered mat by pressing, the woodbased materials being strands that are thin plate-like cut pieces of wood elongated in a fiber direction and having a density of 300 kg/m$^3$ or more and less than 700 kg/m$^3$.

The method includes a pretreatment step of, before stacking the woodbased materials into the multi-layered mat, softening, compressing or squeezing the woodbased materials by performing at least one of the following treatments on the woodbased materials: physical treatment in which the woodbased materials are physically compressed; high-frequency treatment in which the woodbased materials are irradiated with high-frequency waves so as to be dielectrically heated from inside and softened; high-temperature high-pressure treatment in which the woodbased materials are subjected to high temperature and high pressure; high-water pressure treatment in which surfaces of the woodbased materials are finely scratched by high-pressure water; repeated deaeration and dehydration treatment in which the woodbased materials are saturated with water and then moisture is removed from the woodbased materials under vacuum conditions; and chemical treatment in which the woodbased materials are treated with alkali. The multi-layered mat formed by the woodbased materials subjected to the pretreatment step is subjected to the pressing at a press pressure of 4 N/mm$^2$ or less to form a high-density wood laminate material with a density of 750 to 950 kg/m$^3$.

With this configuration, a wood laminate material is formed by orienting and stacking a large number of woodbased materials such that their fibers extend in the predetermined reference direction to form mats of the woodbased materials, stacking the mats in multiple layers to form a multi-layered mat of the woodbased materials, and compressing and bonding the multi-layered mat by the pressing. The woodbased materials are strands that are thin plate-like cut pieces of wood elongated in the fiber direction, and the woodbased materials have a density of 300 kg/m$^3$ or more and less than 700 kg/m$^3$. In the pretreatment step that is performed before the pressing, the woodbased materials are pretreated so as to be softened, compressed or squeezed, before the woodbased materials are stacked into a multi-layered mat. That is, in this pretreatment step, the woodbased materials are subjected to at least one of the physical treatment, the high-frequency treatment, the high-temperature high-pressure treatment, the high-water pressure treatment, the repeated deaeration and dehydration treatment, and the chemical treatment. Mats of the pretreated woodbased materials are stacked in multiple layers to form a multi-layered mat, and the multi-layered mat is compressed and bonded by the pressing, whereby a high-density wood laminate material is produced. As described above, before the pressing, the woodbased materials are pretreated so as to be softened or compressed (squeezed). Accordingly, even a high-density wood laminate material having a density as high as 750 to 950 kg/m$^3$ can be formed by using a press pressure as low as 4 N/mm$^2$ or less, which is about the same as the press pressures required to produce wood laminate materials with common densities. High-density wood laminate materials can thus be produced with improved production efficiency without using special facilities and equipment that are designed in consideration of the risk of delamination.

In the above method, it is preferable that the physical treatment include beating in which the woodbased materials are compressed and deformed by beating, roll pressing in which the woodbased materials are compressed by a roll press machine, or flat press pressing in which the woodbased materials are compressed by a flat press machine.

Since the physical treatment includes beating, roll pressing, or flat press pressing, desired physical treatment can be performed on the woodbased materials by these treatments.

It is preferable that the pretreatment step be comprised of at least one of a first treatment process in which at least one of the beating, the high-frequency treatment, the high-temperature high-pressure treatment, the high-water pressure treatment, the repeated deaeration and dehydration treatment, and the chemical treatment is performed, and a second treatment process in which the roll pressing or the flat press pressing is performed.

In this case, the pretreatment step for the woodbased materials is comprised of at least one of the first and second treatment processes. Desired pretreatment can thus be performed by the first and second treatment processes.

It is preferable that, in the pretreatment step, the second treatment process be performed after the first treatment process. In this case, as the pretreatment for the woodbased materials, at least one of the beating, the high-frequency treatment, the high-temperature high-pressure treatment, the high-water pressure treatment, the repeated deaeration and dehydration treatment, and the chemical treatment is first performed in the first treatment process, and the roll pressing or the flat press pressing is then performed in the subsequent second treatment process. Since the first treatment process is performed before the second treatment process, the pressure required for the roll pressing or the flat press pressing in the second treatment process can be reduced as compared to the case where only the second treatment process is performed as the pretreatment step. This restrains destruction etc. of the woodbased materials and improves strength of the wood laminate material accordingly.

According to the present invention, mats of a large number of woodbased materials are stacked in multiple layers to form a multi-layered mat of the woodbased materials, and the multi-layered mat is compressed and bonded by pressing, whereby a wood laminate material is formed. The woodbased materials are strands that are thin plate-like cut pieces of wood elongated in the fiber direction. When forming such a wood laminate material, specific pretreatment in which the woodbased materials are softened, compressed or squeezed is performed before the woodbased materials are stacked into a multi-layered mat.

Accordingly, a high-density wood laminate material having a density as high as 750 to 950 kg/m$^3$ can be formed by performing the pressing on the multi-layered mat at a press pressure as low as 4 N/mm$^2$ or less, which is about the same as the press pressures required to produce wood laminate materials with common densities. High-density wood laminate materials can thus be produced with high production efficiency without using special facilities and equipment.

BRIEF DESCRIPTION OF THE DRAWINGS

FIG. 4 is a table showing test results of Examples 1, 2 and Comparative Examples 1, 2.

DETAILED DESCRIPTION

An embodiment of the present invention will be described in detail below. The following description of the embodiment is merely exemplary in nature and is not intended in any way to limit the invention, its applications or uses.

Figure 1:
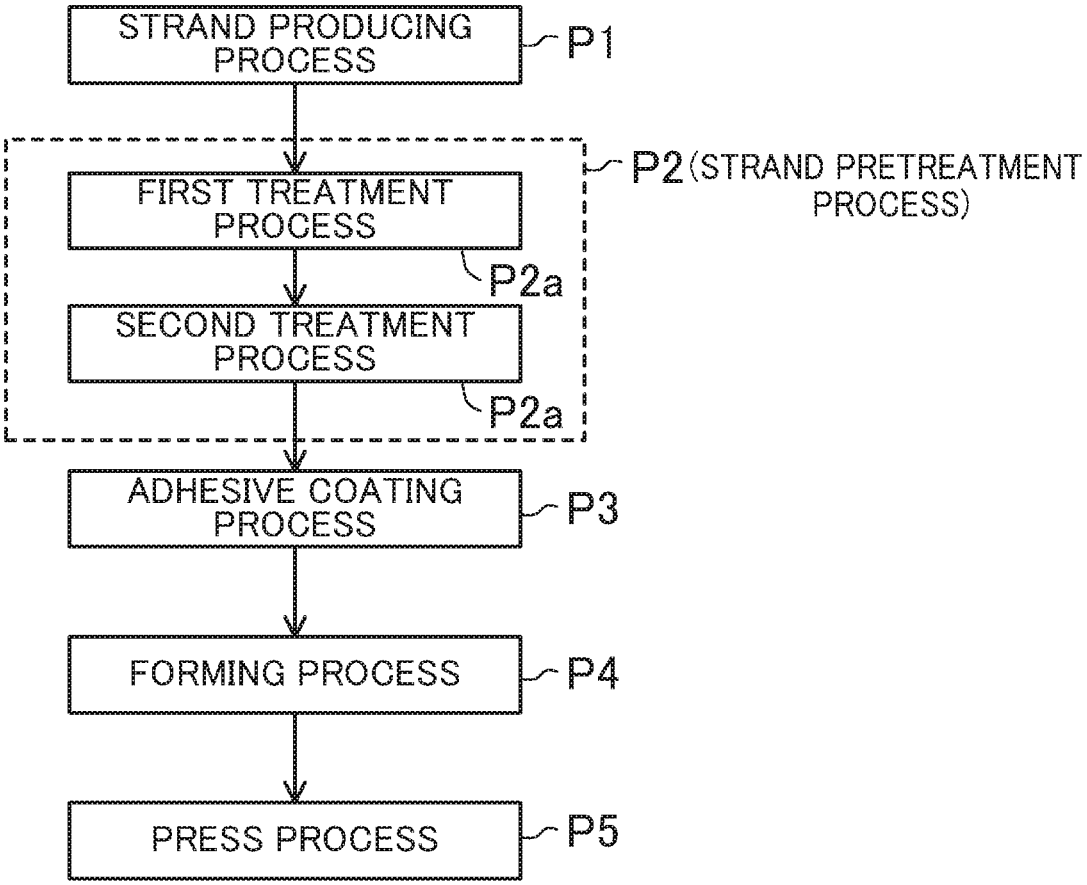
FIG. 1 is a block diagram illustrating a manufacturing process of a strand board according to an embodiment of the present invention.
Figure 2:
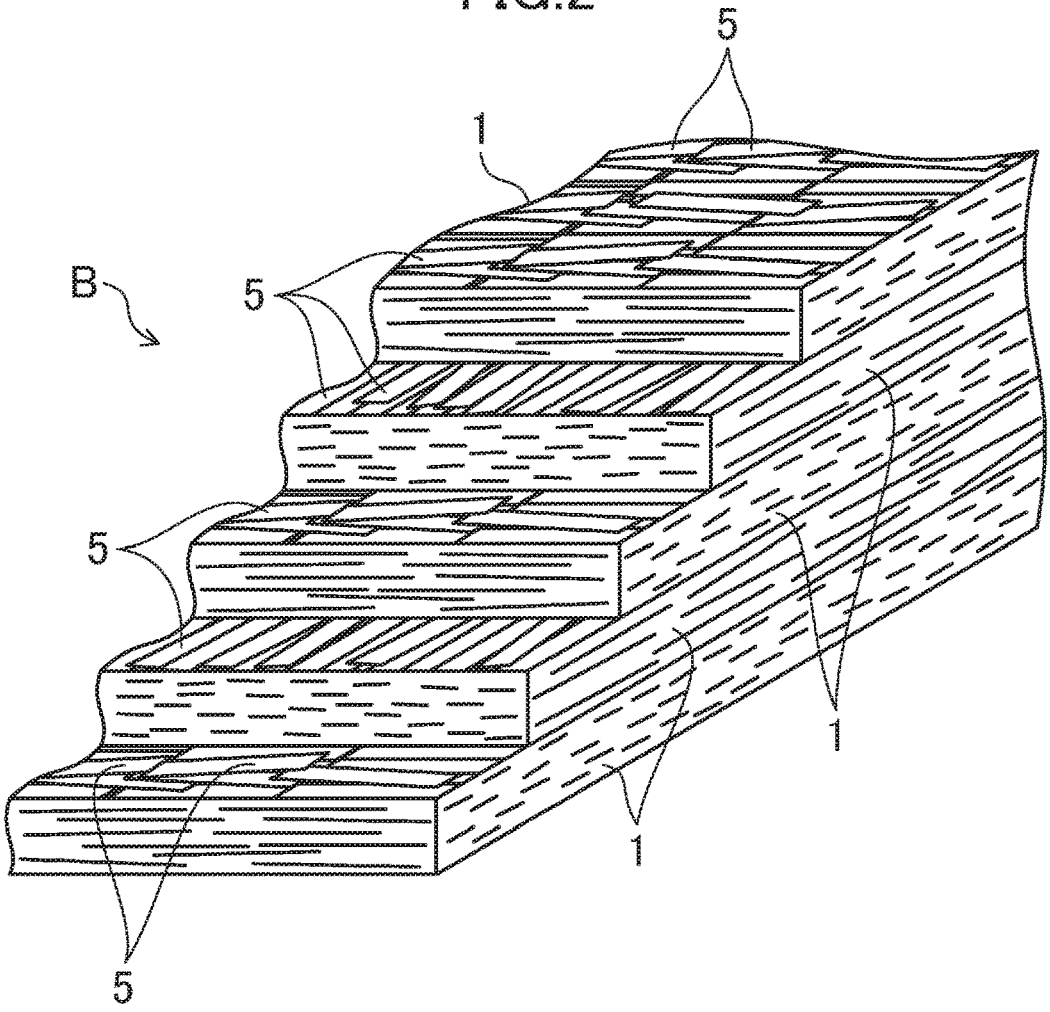
FIG. 2 is a perspective view of a manufactured strand board.
Figure 3:
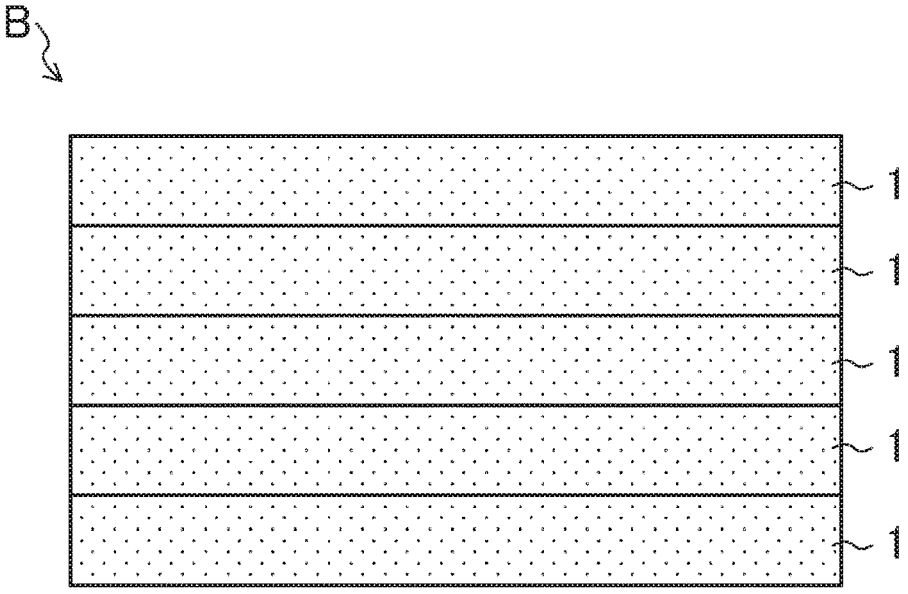
FIG. 3 is a schematic sectional view of stacked strand layers of the strand board.

FIG. 1 shows a manufacturing process of a method for manufacturing a high-density strand board B that is a high-density wood laminate material according to an embodiment of the present invention. FIGS. 2 and 3 show a strand board B manufactured by this method. First, the strand board B will be described.

As shown in FIGS. 2 and 3, the strand board B has multiple (in the illustrated example, five) strand layers 1, 1, . . . as woodbased material layers. Each strand layer 1 is a mat of a large number of strands 5, 5, . . . (woodbased materials) that are cut pieces. Multiple mats of strands 5, 5, . . . are stacked together to form multiple strand layers 1, 1, . . . .

FIGS. 2 and 3 show an example in which all of the multiple strand layers 1, 1, . . . have the same thickness. That is, with the upper side in FIGS. 2 and 3 being the top and the lower side being the bottom, the top and bottom strand layers 1, 1 have the same thickness as the three intermediate strand layers 1, 1, . . . . The multiple strand layers 1, 1, . . . may have multiple thicknesses. The strand board B may have any number of strand layers 1, 1, . . . as long as the number of strand layers 1, 1, . . . is two or more. The thickness(es) of the strand layers 1, 1, . . . and the number of strand layers 1, 1, . . . can be changed according to the intended use of the strand board B etc.

For example, the strands 5 are strands or flakes that are about 150 to 200 millimeters long in the fiber direction, about 15 to 25 millimeters wide, and about 0.3 to 2 millimeters thick.

Wood species that are used for the strands 5 are not particularly limited. For example, tropical wood species or broadleaf trees may be used, or other wood species may be used. Specific examples include Cedar (*Cryptomeria japonica*), Cypress (*Chamaecyparis*), sort of firs such as Douglas fir (*Pseudotsuga menziesii*), *Acacia* (*Acacia* spp.), Aspen (*Populus* spp.), Poplar (*Populus* spp.), Pine (*Pinus* spp.) (Hard pine (*Pinus* spp.), Soft pine (*Pinus* spp.), *Radiata* pine (*Pinus radiata*), etc.), Birch (*Betula* spp.), and Rubber tree (Rubber wood (*Hevea brasiliensis*)). However, the wood species that are used for the strands 5 are not limited to these, and various other wood species may be used. Examples of the various other wood species include: Japanese wood species such as Sawara cypress (*Chamaecyparis pisifera*), Japanese elkhorn cypress (*Thujopsis dolabrata*), Japanese nutmeg-yew (*Torreya nucifera*), Southern Japanese hemlock (*Tsuga sieboldii*), Podocarp (*Podocarpus macrophyllus*), *Pinus* spp., Princess tree (*Paulownia tomentosa*), Maple (*Acer* spp.), Birch (*Betula* spp.) (Japanese white birch (*Betula platyphylla*)), Chinquapin (*Castanopsis* spp.), Japanese beech (*Fagus* spp.), Live oak (*Quercus* spp.), *Abies firma*, Sawtooth oak (*Quercus acutissima*), Oak (*Quercus* spp.), Camphor tree (*Cinnamomum camphora*), and Japanese *zelkova* (*Zelkova serrata*); North American wood species such as Port Orford cedar (*Chamaecyparis lawsoniana*), Yellow cedar (*Callitropsis nootkatensis*), Western redcedar (*Thuja plicata*), Grand fir (*Abies grandis*), Noble fir (*Abies procera*), White fir (*Abies concolor*), Spruce (*Picea* spp.), Western hemlock (*Tsuga heterophylla*), and Redwood (*Sequoia sempervirens*); tropical hardwood species such as *Agathis* (*Agathis* spp.), *Terminalia* (*Terminalia* spp.), Lauan (*Shorea* spp.), Meranti (*Shorea* spp.), Sengon laut (*A. falcataria*), Jongkong (*Dactylocladus stenostachys*), Kamerere (*Eucalyptus deglupta*), Kalampayan (*Anthocephalus chinensis*), Amberoi (*Pterocymbium beccarii*), Yemane (*Gmelina arborea*), Teak (*Tectona grandis*), and Apitong (*Dipterocarpus* spp.); and other foreign wood species such as Balsa (*Ochroma pyramidale*), Cedro (*Cedrela odorata*), Mahogany (*Swietenia* spp.), Lignum-vitae (*Guaiacum* spp.), *Acacia mangium*, Aleppo pine (*Pinus halepensis*), Bamboo, *Sorghum* (*Sorghum nervosum* Bess.), and Kamerere (*Eucalyptus deglupta*). Any material can be used for the strands 5.

Regarding physical properties of the strands 5, the strands 5 preferably have a density of about 300 to 1100 kg/m$^3$, more preferably 380 to 700 kg/m$^3$. If the density of the strands 5 is less than 300 kg/m$^3$, a thicker multi-layered mat is required to form a strand board B of the same density and strength, and a higher press pressure need be used for hot pressing in a press process P5 described later.

The strands 5 may have a density higher than 1100 kg/m$^3$, but it is difficult to obtain such strands 5. Namely, if strands 5 having a density higher than 1100 kg/m$^3$ can be easily obtained, the upper limit of the density is not limited to 1100 kg/m$^3$ and may be higher than 1100 kg/m$^3$.

The moisture content of the strands 5 is preferably about 2 to 20%, more preferably 2 to 8%. If the moisture content is less than 2%, it takes more time to soften the multi-layered mat in the hot pressing of the press process P5. Namely, the press time is increased, which may cause reduction in strength.

If the moisture content of the strands 5 is higher than 20%, it takes more time to heat and compress the multi-layered mat in the hot pressing, which tends to cause delamination. Moreover, curing of an adhesive is inhibited, which may cause reduction in strength.

In each strand layer 1, a large number of strands 5, 5, . . . are oriented such that the fiber direction (longitudinal direction of the strands 5), which is the direction in which fibers (not shown) of the strands 5, 5, . . . extend, is a predetermined direction. As also shown in FIG. 2, in each strand layer 1, the fibers of the strands 5, 5, . . . need not necessarily extend in exactly the same direction. In other words, the fiber directions of the oriented strands 5, 5, . . . do not have to be parallel to each other. Namely, the fiber directions of a part of the strands 5, 5, . . . may be tilted to some extent (e.g., by about 20°) with respect to a predetermined reference direction.

In the present embodiment, the multiple strand layers 1, 1, . . . are stacked and bonded such that the fibers of the strands 5, 5, . . . in adjoining ones of the strand layers 1 extend in directions perpendicular to or crossing each other. That is, of the five strand layers 1, 1, . . . , the fiber direction of the strands 5, 5, . . . in the top strand layer 1 (uppermost layer in FIGS. 2 and 3) is the same as that of the strands 5, 5, . . . in the bottom strand layer 1 (lowermost layer in FIGS. 2 and 3).

Alternatively, the multiple strand layers 1, 1, . . . may be stacked and bonded such that the fibers of the strands 5, 5, . . . in adjoining ones of the strand layers 1 extend parallel or substantially parallel to each other.

The strand layers 1, 1, . . . of the strand board B may have about the same density or may have different densities from each other. In the latter case, at least one of the strand layers 1, 1, . . . of the strand board B is a high-density strand layer having a higher density than the remainder of the strand layers 1, and the remainder of the strand layers 1 is a low-density strand layer(s). The "density of the strand layer 1" as used herein does not refer to the density of the individual strands 5 but refers to the density of the strand layer 1 that is a mat of the strands 5.

The overall density of the strand board B is as high as 750 to 950 kg/m$^3$.

Next, a method for manufacturing a strand board B according to the present embodiment will be described with reference to FIG. 1. This manufacturing method includes a strand producing process P1, a strand pretreatment process P2, an adhesive coating process P3, a forming process P4 (mat forming process), and a press process P5 (forming and compressing process).

(Strand Producing Process)

In the method for manufacturing a strand board B, the strand producing process P1 is first performed in which a large number of strands 5, 5, . . . (cut pieces of wood etc.) are produced. This process P1 includes a cutting process, which is a process of cutting a raw material (raw wood) with, e.g., a cutting machine. The strands 5, 5, . . . are produced by this cutting process. Examples of the raw material include: green wood such as logs or thinnings; wood scraps, wood wastes, etc. that are generated at construction sites etc.; and waste wood pallets.

(Strand Pretreatment Process)

After the strand producing process P1, the large number of strands 5, 5, . . . are subjected to the strand pretreatment process P2. This strand pretreatment process P2 is a process in which strands 5 are softened or compressed (squeezed) in order to allow low-pressure pressing using a pressure (press pressure) as low as, e.g., about 4 N/mm$^2$ to be performed in the later press process P5. At least one of physical treatment, high-frequency treatment, high-temperature high-pressure treatment, high-water pressure treatment, repeated deaeration and dehydration treatment, and chemical treatment is performed in the strand pretreatment process P2.

Specifically, the strand pretreatment process P2 is comprised of two processes, namely a first treatment process P2*a* and a subsequent second treatment process P2*b*. At least one of beating, high-frequency treatment, high-temperature high-pressure treatment, high-water pressure treatment, repeated deaeration and dehydration treatment, and chemical treatment is performed in the first treatment process P2*a*, and roll pressing or flat press pressing is performed in the second treatment process P2*b*. The beating in the first treatment process P2*a* and the roll pressing and the flat press pressing in the second treatment process P2*b* are examples of the above physical treatment in which the strands 5 are physically compressed.

The beating that is performed in the first treatment process P2*a* is a point compression method in which, as in metal forging, strands 5 are compressed and deformed by beating with multiple spring hammers arranged continuously etc. The strands 5 are thus compressed without being smashed, whereby high-density strands 5 are produced.

The high-frequency treatment is a method in which strands 5 as dielectrics (nonconductors) are irradiated with high-frequency electromagnetic waves (high-frequency waves) between electrodes etc. for, e.g., about two minutes so as to be dielectrically heated from the inside and softened. This method allows low-pressure pressing using a low press pressure to be performed in the later press process P5 without increasing the density of the strands 5. Especially in the case where the strands 5 are made of wood with a high moisture content, moisture in the wood absorbs the high-frequency electromagnetic waves as the wood is irradiated therewith. Heat is thus generated and a vapor pressure in the wood increases accordingly. The moisture in the wood thus turns into hot water or water vapor, which moves toward the outside. The wood is significantly softened through this process.

The high-temperature high-pressure treatment is a method in which strands 5 are placed in a pressure vessel where the strands 5 are subjected to high temperature and high pressure so that cell walls of the strands 5 (woodbased materials) are damaged and the strands 5 are softened. For example, this method is performed at 180° C. and about 10 Bar for about two minutes. This method also allows low-pressure pressing using a low press pressure to be performed in the later press process P5 without increasing the density of the strands 5.

The high-water pressure treatment is a method in which strands 5 are uniformly formed within a mesh material such as metal wire mesh and the surfaces of the strands 5 are finely scratched by high-pressure water of, e.g., about 200 MPa through the mesh material. This produces fine fractures in the strands 5 and softens the strands 5.

The repeated deaeration and dehydration treatment is a method in which strands 5 are first saturated with water and then placed in a batch type of vessel, and with the vessel being evacuated to vacuum, moisture is removed from the strands 5 to facilitate damage to cell walls of the strands 5 (woodbased materials) and thus soften the strands 5. This method also allows low-pressure pressing using a low press pressure to be performed in the later press process P5 without increasing the density of the strands 5.

The chemical treatment is a method in which, for example, sodium hydroxide etc. is added to strands 5 for alkaline treatment to facilitate plasticization of the strands 5 themselves and thus soften the strands 5. In the case where the strands 5 are treated with sodium hydroxide, the strands 5 are immersed in, e.g., a 10 to 15% sodium hydroxide aqueous solution for a certain time. Alternatively, the strands 5 may be immersed in a 10 to 20% potassium hydroxide aqueous solution for a certain time. This method also allows low-pressure pressing using a low press pressure to be performed in the later press process P5 without increasing the density of the strands 5.

The roll pressing that is performed in the second treatment process P2*b* is a linear compression method in which a large number of strands 5, 5, . . . (woodbased materials) are first placed in a roll press machine (not shown) such that the strands 5, 5, . . . evenly drop thereon, and the strands 5, 5, . . . are then compressed. For example, this roll pressing is performed under the following conditions: temperature: room temperature to 250° C., clearance between heat rolls: about 0.2 mm, feed rate: about 50 m/min, and compression ratio: about 30 to 60%. The strands 5 are thus compressed without being destroyed, whereby high-density strands 5 are produced.

The flat press pressing is a surface compression method in which strands 5, 5, . . . (woodbased materials) are placed in a flat heat press machine (not shown) and compressed with heat. For example, the flat press pressing is performed at 120° C. and about 4 N/mm$^2$ for about five minutes. The compression ratio is about 10 to 30%. In the flat press pressing as well, the strands 5 are compressed without being destroyed, whereby high-density strands 5 are produced.

In the high-frequency treatment, the high-temperature high-pressure treatment, the high-water pressure treatment, the repeated deaeration and dehydration treatment, and the chemical treatment, the state of the strands 5 after the treatment is maintained by drying the strands 5 as necessary after the treatment.

In the strand pretreatment process P2, the order of the first and second treatment processes P2*a*, P2*b* may be reversed. Namely, the first treatment process P2*a* may be performed after the second treatment process P2*b*. Alternatively, only one of the first and second treatment processes P2*a*, P2*b* may be performed. However, it is preferable to perform the second treatment process P2*b* after the first treatment process P2*a* because this reduces the pressure required for the roll pressing or the flat press pressing that is performed in the second treatment process P2*b* and thus restrains destruction etc. of the strands 5 and improves strength of the strand board B.

(Adhesive Coating Process)

After the large number of strands 5, 5, . . . are thus produced, the adhesive coating process P3 is performed in which the strands 5, 5, . . . are coated with an adhesive. For example, the adhesive may be an isocyanate adhesive or may be an amine adhesive such as a phenol resin, urea resin, or melamine resin.

(Forming Process)

Thereafter, the forming process P4 (mat forming process) is performed in which the large number of strands 5, 5, . . . are oriented and stacked to form strand mats and the strand mats are stacked in multiple layers to form a multi-layered mat.

Specifically, with a mat forming machine etc., a large number of strands 5, 5, . . . coated with the adhesive are dispersed while being oriented such that their fibers extend in a predetermined reference direction, and are stacked to a thickness of, e.g., about 7 to 12 mm to form a strand mat with a certain thickness. The thickness of the strand mat is not limited to the above values. The thickness of the strand mat may be less than 7 mm or more than 12 mm.

After the strand mat with a certain thickness is thus formed, strands 5, 5, . . . oriented such that, e.g., their fiber direction is perpendicular to or crosses that of the strands 5, 5, . . . of the strand mat are dispersed and stacked on top of the strand mat to form another strand mat with a certain thickness.

Subsequently, an additional strand mat is repeatedly stacked in a similar manner until the stack has a desired number of layers (e.g., five layers). At this time, the strand mats are stacked such that the fiber directions of the strands 5, 5, . . . in adjoining ones of the strand mats are perpendicular to or cross each other. A multi-layered mat is formed in this manner. In the case of the strand board B having the five strand layers 1, 1, . . . as shown in FIGS. 2 and 3, the thickness of the five-layered mat is, e.g., about 35 to 60 mm.

The number of strand mats in the multi-layered mat is determined based on the number of layers in the strand board B.

The density of the strands 5, 5, . . . of the strand layer 1 may be either about the same or different between or among the multiple strand layers 1, 1, . . . .

(Press Process)

After the multi-layered mat is thus formed by stacking multiple strand mats, the press process P5 (forming and compressing process) is performed. In this press process P5, hot pressing is performed at a predetermined pressure and temperature with a hot press machine to compress and bond the multi-layered mat. This hot pressing is performed at a press pressure of 4 N/mm$^2$ or less for, e.g., 10 to 20 minutes. The press time varies depending on the thickness of the strand board B (finished product). Depending on the case, the press time may be less than 10 minutes or may be as long as more than 20 minutes. Pre-heat treatment with a heater may be performed before the hot pressing with the hot press machine.

A strand board B having a density of 750 to 950 kg/m$^3$ and a modulus of rupture (MOR), which is flexural strength, of 80 to 150 N/mm$^2$ is thus manufactured by the processes P1 to P5.

In the present embodiment, mats of strands 5, 5, . . . are stacked in multiple layers, and the multi-layered mat thus obtained is compressed and bonded by pressing to form a strand board B. The strands 5 are pretreated in the strand pretreatment process P2 that is performed before the press process P5. The first treatment process P2*a* and the subsequent second treatment process P2*b* are performed in the strand pretreatment process P2. At least one of beating (physical treatment), high-frequency treatment, high-temperature high-pressure treatment, high-water pressure treatment, repeated deaeration and dehydration treatment, and chemical treatment is performed in the first treatment process P2*a*, and roll pressing or flat press pressing (both of them are physical treatments) is performed in the second treatment process P2*b*.

Mats of the pretreated strands 5 are stacked in multiple layers in the forming process P4 (mat forming process), and the multi-layered mat thus obtained is compressed and bonded by pressing in the press process P5. A high-density strand board B having a density of 750 to 950 kg/m$^3$ is thus produced.

As described above, before the pressing in the press process P5, the strands 5 are pretreated in the strand pretreatment process P2 so as to be softened or compressed (squeezed). Accordingly, even a strand board B having a density as high as 750 to 950 kg/m$^3$ can be formed with a press pressure as low as 4 N/mm$^2$ or less, which is about the same as the press pressures required to produce strand boards with common densities.

High-density strand boards B can thus be produced with improved production efficiency without using special facilities and equipment designed in consideration of the risk of delamination.

Especially in the strand pretreatment process P2, at least one of beating, high-frequency treatment, high-temperature high-pressure treatment, high-water pressure treatment, repeated deaeration and dehydration treatment, and chemical treatment is performed in the first treatment process P2*a*, and roll pressing or flat press pressing is performed in the subsequent second treatment process P2*b*. Since the first treatment process P2*a* is performed before the second treatment process P2*b*, the pressure required for the roll pressing or the flat press pressing in the second treatment process P2*b* is lower than in the case where only the second treatment process P2*b* is performed as a strand pretreatment process. This restrains destruction etc. of the strands 5 and improves strength of the strand board B accordingly.

OTHER EMBODIMENTS

The above embodiment is described with respect to the method for manufacturing a high-density strand board B by stacking and bonding mats of strands 5, 5, . . . into a board. However, the present invention is not limited to such a method. For example, the present invention is also applicable to a method for manufacturing a high-density strand material (wood laminate material) by stacking and bonding multiple strand layers having a rectangular section (in the shape of squared timber) and having no significant difference between thickness and width. In this case, a high-density strand material can be used for joists, pillars, etc.

EXAMPLES

Next, specific examples will be described.

Example 1

Cypress (*Chamaecyparis*) strands were subjected to roll pressing as a strand pretreatment process. The strands were 150 to 200 mm long in the fiber direction, 15 to 25 mm wide, and 0.8 to 2 mm thick and had a density of 300 to 450 kg/m$^3$. The roll pressing was performed under the following conditions: temperature: 250° C., clearance between hot rolls: 0.5 mm, feed rate: about 1.5 m/min, and compression ratio: 40%. Mats of a large number of strands thus subjected to the roll pressing were stacked into a multi-layered mat having five strand layers and a thickness of 37 mm. The multi-layered mat was then subjected to hot pressing at 140° C. and 4 N/mm$^2$ for 10 minutes to produce a strand board with a density of 818 kg/m$^3$ and a thickness of 12.4 mm. This strand board was used as Example 1.

Figure 5:
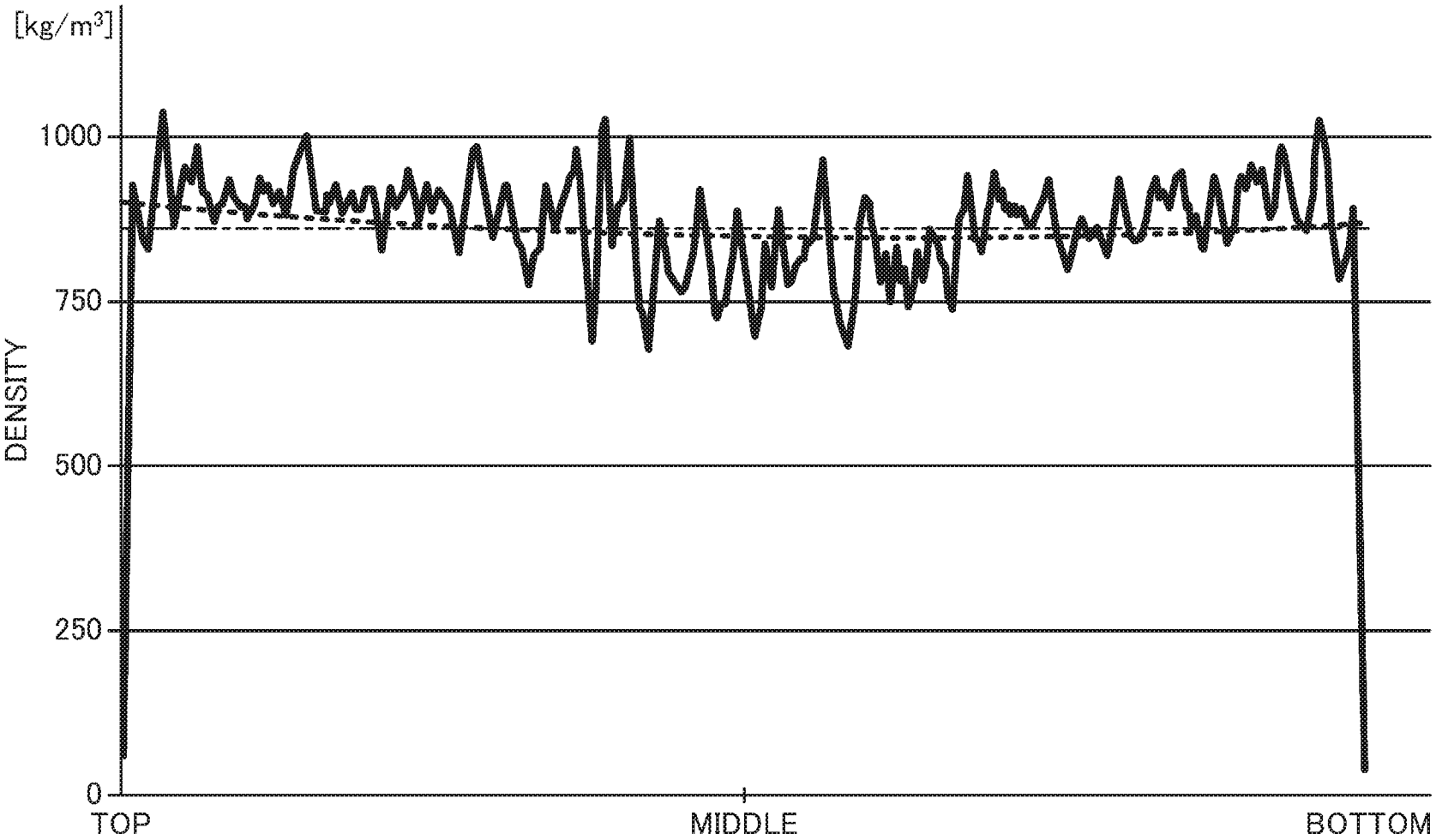
FIG. 5 is a graph showing density distribution of a strand board of Example 1.

FIG. 4 shows the results of a bending test, a dimensional change test, and a water absorption test for Example 1. FIG. 5 shows the density distribution in the thickness direction (stacking and bonding direction) of the strand board measured with a density profile analyzer ("DENSE-LAB X" made by ELECTRONIC WOOD SYSTEMS GMBH).

Example 2

Douglas fir (*Pseudotsuga menziesii*) strands were subjected to roll pressing as a strand pretreatment process. The strands were 150 to 200 mm long in the fiber direction, 15 to 25 mm wide, and 0.8 to 2 mm thick and had a density of 350 to 450 kg/m$^3$. The roll pressing was performed under the same conditions as those of Example 1. Mats of a large number of strands thus subjected to the roll pressing were stacked into a multi-layered mat having five strand layers and a thickness of 36 mm. The multi-layered mat was then subjected to hot pressing at 140° C. and 4 N/mm$^2$ for 10 minutes to produce a strand board with a density of 832 kg/m$^3$ and a thickness of 12.2 mm. This strand board was used as Example 2. FIG. 4 shows the results of the bending test, the dimensional change test, and the water absorption test for Example 2.

Comparative Example 1

Figure 6:
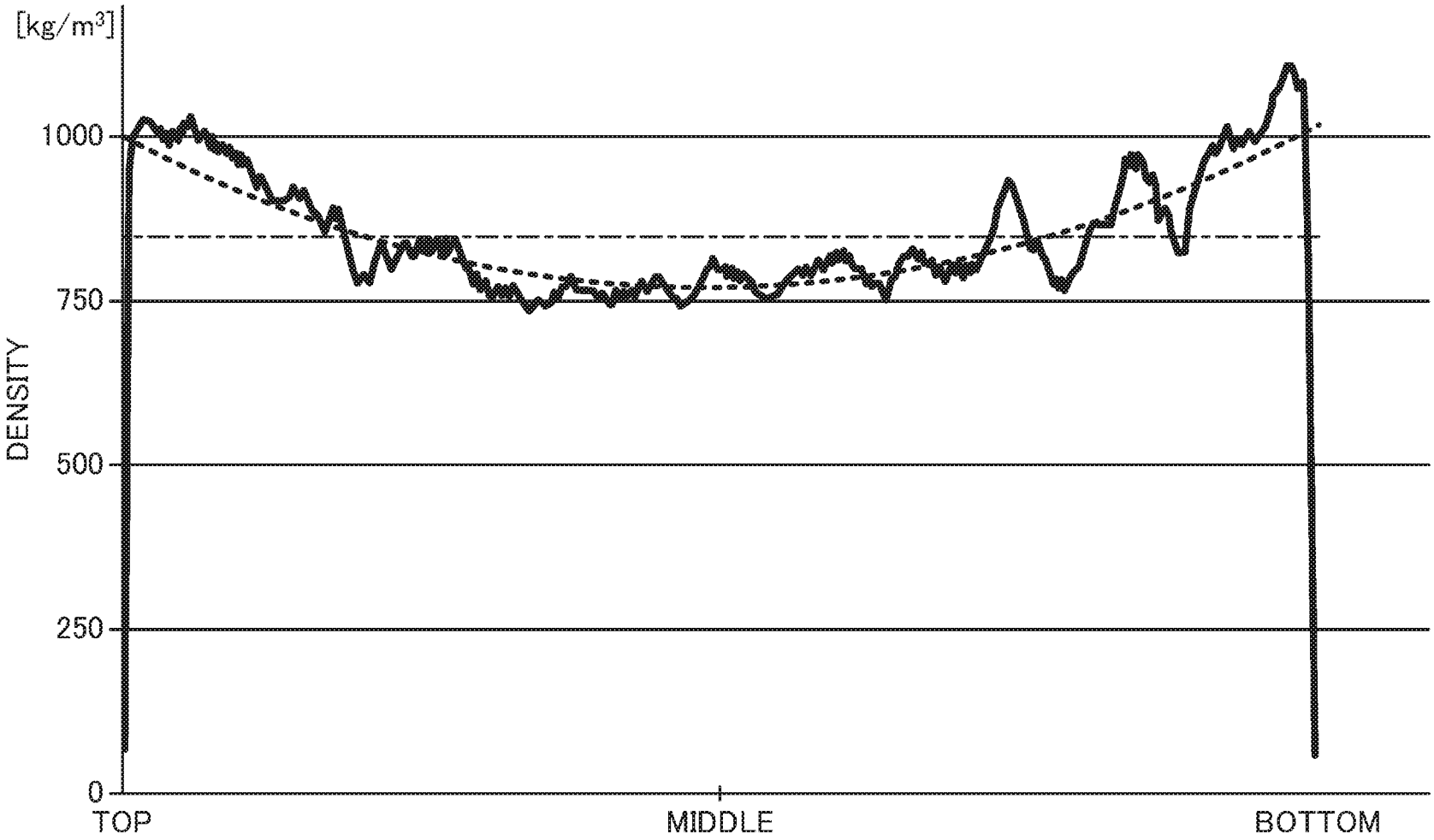
FIG. 6 is a graph showing density distribution of a strand board of Comparative Example 1.

Mats of a large number of cypress (*Chamaecyparis*) strands were stacked into a multi-layered mat having five strand layers and a thickness of 42 mm without performing such a strand pretreatment process as in Examples 1, 2. The strands were 150 to 200 mm long in the fiber direction, 15 to 25 mm wide, and 0.8 to 2 mm thick and had a density of 300 to 450 kg/m$^3$. The multi-layered mat was then subjected to hot pressing at 140° C. and 8 N/mm$^2$ for 10 minutes to produce a strand board with a density of 779 kg/m$^3$ and a thickness of 12.7 mm. This strand board was used as Comparative Example 1. FIG. 4 shows the results of the bending test, the dimensional change test, and the water absorption test for Comparative Example 1. FIG. 6 shows the density distribution in the thickness direction (stacking and bonding direction) of the strand board measured with the density profile analyzer ("DENSE-LAB X" made by ELECTRONIC WOOD SYSTEMS GMBH).

Comparative Example 2

Mats of a large number of Douglas fir (*Pseudotsuga menziesii*) strands were stacked into a multi-layered mat having five strand layers and a thickness of 35 mm without performing such a strand pretreatment process as in Examples 1, 2. The strands were 150 to 200 mm long in the fiber direction, 15 to 25 mm wide, and 0.8 to 2 mm thick and had a density of 350 to 450 kg/m$^3$. The multi-layered mat was then subjected to hot pressing at 140° C. and 8 N/mm$^2$ for 10 minutes to produce a strand board with a density of 812 kg/m$^3$ and a thickness of 12.4 mm. This strand board was used as Comparative Example 2. FIG. 4 shows the results of the bending test, the dimensional change test, and the water absorption test for Comparative Example 2.

The bending test was conducted in accordance with IICL_Floor_Performance TB001 Ver. 2. The dimensional change test and the water absorption test were conducted in accordance with the cyclic boiling test of Japanese Agricultural Standard for plywood.

The results in FIG. 4 show that Example 1 is higher in density, modulus of rupture (MOR), namely flexural strength, and modulus of elasticity (MOE) than Comparative Example 1. Percentage dimensional change and water absorption of Example 1 are about the same as those of Comparative Example 1. Example 2 has a higher density than Comparative Example 2, approximately the same MOR, namely flexural strength, as Comparative Example 2, and a higher MOE than Comparative Example 2. Percentage dimensional change and water absorption of Example 2 are about the same as those of Comparative Example 2.

Comparison between Examples 1, 2 and Comparative Examples 1, 2 shows that, by pretreating strands by roll pressing and then performing hot pressing on a multi-layered mat of the pretreated strands as in Examples 1, 2, strand boards with densities higher than those of Comparative Examples 1, 2 were able to be formed even through the hot pressing was performed at a press pressure as low as 4 N/mm$^2$.

The results in FIGS. 5 and 6 show that Example 1 has substantially constant density distribution in the stacking and bonding direction of the multiple strand layers as compared to Comparative Example 1. The substantially constant density distribution includes such density distribution that, in the case where the measured density distribution fluctuates as shown in, e.g., FIGS. 5 and 6, such a median as shown by dashed line in each figure changes only slightly and is substantially constant. For example, as can be seen from comparison between the dashed line in FIG. 5 (Example 1) and the dashed line in FIG. 6 (Comparative Example 1), the median of the density distribution shown in FIG. 5 changes less than the median of the density distribution shown in FIG. 6 and is substantially constant.

Since the density distribution is substantially constant, the strand board has uniform density distribution and has improved overall water resistance and strength (shear strength etc.). Specifically, low-density parts of a strand board have lower water resistance and strength than high-density parts thereof. Accordingly, if a strand board has non-uniform density distribution, the overall performance of the strand board is governed by the water resistance and strength of low-density parts of the strand board. However, in the case where a strand board has substantially constant density distribution, such parts of the strand board which become a bottleneck for performance can be eliminated.

The present invention is suitable for use as flooring materials for containers, watercraft, vehicles, etc. The present invention is extremely useful because high-density building materials that are also suitable for use as flooring materials and structural bracing boards for buildings such as houses can be produced by using a low press pressure. The present invention thus has high industrial applicability.

What is claimed is:

1. A method for manufacturing a high-density wood laminate material, comprising:

providing strands of woodbased material that are thin plate cut pieces of wood elongated in a fiber direction and having a density of 300 kg/m$^3$ or more and less than 700 kg/m$^3$, pretreating the strands of woodbased material by softening, compressing or squeezing the strands of woodbased material, orienting the strands of woodbased material such that fibers of the strands of woodbased material extend in a predetermined reference direction to form mats of the strands of woodbased material, stacking the mats of the strands of woodbased material in multiple layers to form a multi-layered mat of the strands of woodbased material, and pressing at a pressure of 4 N/mm$^2$ or less to compress and bond the multi-layered mat, wherein the pretreating step is performed before the stacking step, the pretreating step including at least one of the following treatments on the strands of woodbased material: physical treatment in which the strands of woodbased material are physically compressed; high-frequency treatment in which the strands of woodbased material are irradiated with high-frequency waves so as to be dielectrically heated from inside and softened; high-temperature high-pressure treatment in which the strands of woodbased material are subjected to high temperature and high pressure; high-water pressure treatment in which surfaces of the strands of woodbased material are finely scratched by high-pressure water; and repeated deaeration and dehydration treatment in which the strands of woodbased material are saturated with water and then moisture is removed from the strands of woodbased material under vacuum conditions; and wherein the pretreating step is performed in order that the multi-layered mat pressed during the pressing step at the pressure forms the high-density wood laminate material with a density of 750 to 950 kg/m$^3$.

2. The method of claim 1, wherein the physical treatment includes beating in which strands of woodbased material are compressed and deformed by beating, roll pressing in which the strands of woodbased material are compressed by a roll press machine, or flat press pressing in which the strands of woodbased material are compressed by a flat press machine.

3. The method of claim 2, wherein the pretreatment step is comprised of at least one of a first treatment process in which at least one of the beating, the high-frequency treatment, the high-temperature high-pressure treatment, the high-water pressure treatment, the repeated deaeration and dehydration treatment, and the chemical treatment is performed, and a second treatment process in which the roll pressing or the flat press pressing is performed.

4. The method of claim 3, wherein in the pretreatment step, the second treatment process is performed after the first treatment process.

5. A method for manufacturing a high-density wood laminate material, comprising:

providing strands of woodbased material that are thin plate cut pieces of wood elongated in a fiber direction and having a density of 300 kg/m$^3$ or more and less than 700 kg/m$^3$, pretreating the strands of woodbased material, orienting the strands of woodbased material such that fibers of the strands of woodbased material extend in a predetermined reference direction to form mats of the strands of woodbased material, stacking the mats of the strands of woodbased material in multiple layers to form a multi-layered mat of the strands of woodbased material, and pressing to compress and bond the multi-layered mat, wherein the pretreating step is performed before the stacking step, the pretreating step including beating in which the strands of woodbased material are compressed and deformed by beating, roll pressing in which the strands of woodbased material are compressed by a roll press machine, or flat press pressing in which the strands of woodbased material are compressed by a flat press machine, and wherein the pretreating step is performed in order that the multi-layered mat pressed during the pressing step at the pressure of 4 $N/mm^2$ or less forms the high-density wood laminate material with a density of 750 to 950 $kg/m^3$.

* * * * *